US006485609B1

(12) United States Patent
Boylan

(10) Patent No.: US 6,485,609 B1
(45) Date of Patent: Nov. 26, 2002

(54) INK JET PRINTING PAPER INCORPORATING AMINE FUNCTIONAL POLY(VINYL ALCOHOL)

(75) Inventor: John Richard Boylan, Bethlehem, PA (US)

(73) Assignee: Celanese International Corporation, Dallas, TX (US)

( * ) Notice: Subject to any disclaimer, the term of this patent is extended or adjusted under 35 U.S.C. 154(b) by 0 days.

(21) Appl. No.: 09/802,091

(22) Filed: Mar. 8, 2001

(51) Int. Cl.[7] ..... D21H 19/56

(52) U.S. Cl. ..... 162/135; 162/168.2; 162/181.1; 162/181.2; 427/391; 428/511

(58) Field of Search ..... 162/135, 164.6, 162/168.2, 181.1, 181.6; 427/391; 428/511

(56) References Cited

U.S. PATENT DOCUMENTS

| | | | | |
|---|---|---|---|---|
| 4,818,341 A | | 4/1989 | Degen et al. | 162/168.2 |
| 4,880,497 A | | 11/1989 | Pfohl et al. | 162/184 |
| 5,270,103 A | | 12/1993 | Oliver et al. | 428/219 |
| 5,328,748 A | | 7/1994 | Westfal | 428/195 |
| 5,380,403 A | | 1/1995 | Robeson et al. | 162/147 |
| 5,405,678 A | | 4/1995 | Bilodeau | 428/211 |
| 5,570,120 A | | 10/1996 | Sakaki et al. | 347/105 |
| 6,068,733 A | * | 5/2000 | Storbeck et al. | 162/135 |
| 6,096,440 A | | 8/2000 | Moriya et al. | 428/522 |
| 6,096,826 A | | 8/2000 | Rabasco et al. | 525/61 |

FOREIGN PATENT DOCUMENTS

| | | | |
|---|---|---|---|
| DE | 3510565 A1 | 9/1985 | B41M/5/00 |
| EP | 1 022 383 A1 | 7/2000 | D21H/27/00 |
| JP | 61-134291 | 6/1986 | |
| JP | 63162276 A2 | 7/1988 | |
| JP | 63-162276 | 7/1988 | |
| JP | H1-186372 | 7/1989 | |
| JP | 05-139023 | 8/1993 | |
| JP | 5-278323 | 10/1993 | |
| JP | 06-247036 | 6/1994 | |
| WO | WO 01/74599 | 10/2001 | B41M/5/00 |

OTHER PUBLICATIONS

Rodriguez, "Principles of Polymer Systems", p. 98–101, 403, 405 (McGraw–Hill, NY, 1970).

Poly(vinyl alcohol): Properties and Applications, ed. by C.A. Finch, John Wiley & Sons, New York, 1973, p. 91–120.

Poly(vinyl alcohol) Fibers ed. by I. Sokuruda, Marcel Dekker, Inc., New York, 1985, p. 57–68.

"Vinyl Alcohol Polymers", F. L. Marten in the Encyclopedia of Polymer Science and Engineering, 2nd ed., vol. 17, p. 167, John Wiley & Sons, New York, 1989.

"Hewlett Packard Paper Acceptance Criteria For HP Deskjet 500C, 550C & 560C Printers".

* cited by examiner

*Primary Examiner*—Peter Chin
(74) *Attorney, Agent, or Firm*—M. Susan Spiering

(57) ABSTRACT

This invention relates to an improvement in coatings particularly suited for the preparation of paper products having an ink jet coating applied thereto and to the resulting paper products. The improvement in ink jet coatings resides in the incorporation of a primary amine functional polyvinyl alcohol ($PVOH/PVNH_2$) as a polymeric binder. One form of an amine functional polyvinyl alcohol is produced by the hydrolysis of a copolymer of vinyl acetate and N-vinylformamide or vinyl acetate and allyl amine. Another is the polyvinyl butyral derivative of polyvinyl alcohol which typically is formed by the reaction of a 4-amino alkyl aldehyde dialkyl acetal, such as 4-aminobutyraldehyde dimethyl acetal with polyvinyl alcohol.

24 Claims, 8 Drawing Sheets

INK DRY TIME ON SILICA/POLY(vinyl alcohol) COATINGS

INK JET PRINTING PAPER INCORPORATING AMINE FUNCTIONAL POLY(VINYL ALCOHOL)

TECHNICAL FIELD

This invention relates to paper products having a unique coating thereon rendering them well suited for use with ink jet printers.

BACKGROUND OF THE INVENTION

Advances in ink jet printing technology have placed new demands on the printed paper and paper coatings. To function properly the printed substrate must quickly absorb the ink and ink vehicles directly after printing, maximize the ink optical density, minimize ink bleed and wicking, and provide a means of making the inks waterfast.

Ink jet coatings generally comprise silica pigment having a high absorption capability and a polymeric binder such as a poly(vinyl alcohol) binder having a high binding strength. A variety of additives have been utilized to improve coating properties. Cationic additives, for example, have been added to help with ink waterfastness and lightfastness. Other variations in the ink jet coating formulations include the use of non silica pigments such as clays, aluminum hydrate, calcium carbonate, titanium dioxide, magnesium carbonate and the use of binders such as styrene-butadiene, poly(vinyl pyrrolidone), polyvinyl acetate, acrylic binders, and starch.

The following patents and articles are representative of various resins and ink jet paper coatings.

U.S. Pat. No. 4,818,341 discloses the addition of a cationic polymer e.g. hydrolyzed vinyl acetate or vinyl propionate/N-vinyl formamide copolymers to paper stock to enhance the dry-strength in all types of paper and paper board, e.g., writing paper and packaging papers. The polymers are added in an amount of from 35–150 grams per square meter for paper and up to 600 grams per square meter for paper board.

U.S. Pat. No. 4,880,497 discloses the addition of water-soluble copolymers containing polymerized vinyl amine units, e.g., a hydrolyzed vinyl acetate/N-vinyl formamide copolymer to paper stock prior to sheet formation in an amount of from 0.1–5% based on dry fiber.

Japanese-laid open Kokai application 5-278323 discloses a recording sheet having good ink absorptivity, image quality and excellent water resistance which comprises a dye fixing layer and ink adsorption layer laminated thereon. One of the principal components of the dye fixing layer applied to the recording sheet is a cation modified polyvinyl alcohol. Cation modified polyvinyl alcohols are characterized as hydrolyzed copolymers of vinyl acetate and ethylenically unsaturated monomers having quaternary ammonium salt groups. The content of the cationic group is from 0.1–10 mole percent.

An abstract, of Japanese 63162276A2 discloses an image acceptor for ink jet recordings. The image acceptor includes silica pretreated with water soluble resins either on the recording surface or within the acceptor. A solution of sodium silicate and sulfuric acid is mixed with 5% of a cation modified polyvinyl alcohol and applied to a paper sheet and then an ink applied thereto.

Japanese Patent 05139023 discloses an aqueous based ink jet coating comprising silica pigment and a fully hydrolyzed, medium molecular weight poly(vinyl alcohol) coating. This coating is applied to a paper support at coat weights of 0.7 to 0.8 g/cm$^2$ to provide high color quality images with good dot shape.

German patent 514633 A1 921125 describes an ink jet coating which contains 50% silica pigment, 40% poly(vinyl alcohol) having a hydrolysis value of 92.5%, and 10% of a cationic polyacrylamide. When applied to a paper substrate at a coating weight of 10 grams/m$^2$, this coating provides excellent color density and small dot diameters yielding excellent print fidelity.

Japanese patent 01186372 A2 890725 describes the addition of polyacrylamide to an ink jet coating comprising silica pigment and fully hydrolyzed low molecular weight poly (vinyl alcohol). This coating yield good smudge resistance and lightfastness.

Japanese patent 06247036 A2 940906 discloses the use of a cationic polyethyleneimine quaternary ammonium salt in combination with silica pigment and fully hydrolyzed low molecular weight poly(vinyl alcohol) as an ink jet receiving layer.

Japanese patent 61134291 A2 860621 discloses a cationic PVOH binder for use in an ink jet coating; the binder used is a saponified trimethyl-3-(1-acrylamidopropyl)ammonium chloride-vinyl acetate copolymer with a percent hydrolysis of 98.5 and a cationic content of 3 mole % and a degree of polymerization of 1750. Coatings using this binder with silica pigment provide excellent print fidelity and good water resistance to paper.

U.S. Pat. No. 5,405,678 discloses an ink jet paper having a substrate coated with a non coalesced latex film comprised of a hydrophobic polymer, e.g., ethylene-vinyl chloride copolymers, acrylic latexes, silica, and dispersants.

U.S. Pat. No. 5,270, 103 discloses receiver sheets suited for printing with aqueous based inks, such as those used in ink jet printing systems. The coating formulation is comprised of a pigment and a binder consisting of polyvinyl alcohol and another polymer, e.g., cationic polyvinyl alcohol and poly(vinyl pyrrolidone).

U.S. Pat. No. 6,096,826 discloses the synthesis of a amine functional polyvinyl alcohol via the reaction piperidone with poly(vinyl alcohol) particles. The end product was found to be useful as a mordant/binder for ink jet coated papers.

U.S. Pat. No. 6,096,440 discloses the use of an ink jet recording medium having an ink receiving layer composed of hydrophilic resin, a block copolymer of polyvinyl alcohol and a hydrophobic polymer. US '440 further discusses the use of a cationic-modified poly(vinyl alcohol), Kurray CM-318, produced by Kuraray Co. Ltd. as a binder for the ink jet receiving layer.

SUMMARY OF THE INVENTION

This invention relates to an improvement in paper products having an aqueous based ink jet coating applied to its surface. The improvement generally resides in the incorporation of an a primary amine functional polyvinyl alcohol (PVOH/$NH_2$) as a polymeric binder in the ink jet coating. One form of an amine functional polyvinyl alcohol is produced by the hydrolysis of a copolymer of vinyl acetate and N-vinylformamide (PVOH/$PVNH_2$), another formed by the polymerization of vinyl acetate and allyl amine, and another is the 4-aminobutyral derivative of polyvinyl alcohol.

Several advantages are associated with the paper products incorporating the improved ink jet coating. These advantages include:

- the incorporation of a primary amine functional polyvinyl alcohol as a polymer binder in the ink jet coating eases the makedown procedure of the coating formulation by eliminating the need to add cationic materials;

the addition of a primary amine functional polyvinyl alcohol provides excellent binding strength with the silica pigments used in ink jet coatings;

the addition of a primary amine functional polyvinyl alcohol provides excellent ink optical density with regard to monochrome black, composite black, and primary colors;

the addition of a primary amine functional polyvinyl alcohol provides excellent waterfastness to the printed inks;

the addition of a primary amine functional polyvinyl alcohol provides for excellent lightfastness of the inks;

the addition of a primary amine functional polyvinyl alcohol provides for excellent rheological response in terms of shear thickening response when used in conjunction with silica pigment thereby helping the paper coater achieve a greater coating solids level which can allow for higher coat weights and increased production speeds; and the addition of a primary amine functional polyvinyl alcohol provides excellent ink dry time after printing onto the coated ink jet paper.

Typically, a primary amine functional polyvinyl alcohol is selected from the group consisting of: hydrolyzed copolymers of vinyl acetate and N-vinylamide, a hydrolyzed copolymer of vinyl acetate and allylamine, and primary aminoalkylal derivatives of polyvinyl alcohol.

BRIEF DESCRIPTION OF DRAWINGS

The invention is described in detail below in connection with the various figures, in which.

DETAILED DESCRIPTION OF THE INVENTION

Figure 1:
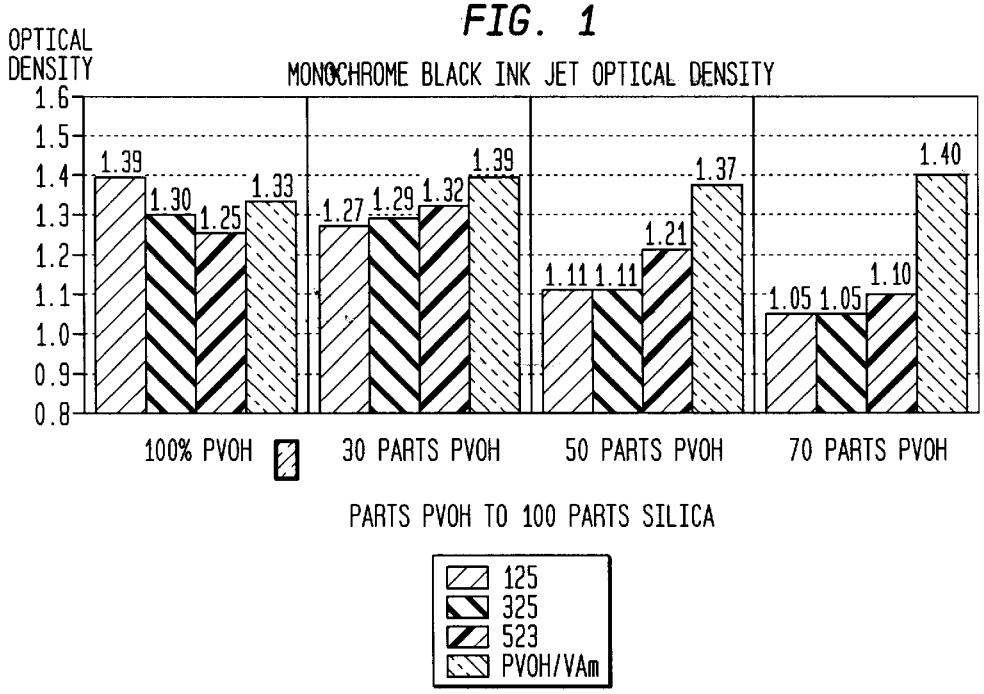
FIG. 1 is a bar graph showing monochrome black ink jet optical density as a function of the resin employed and amount of mineral filler.

The invention relates to improvements in paper products preferentially suited for use with ink jet printers. The key to the preparation of improved paper products for ink jet printing is in the ink jet coating applied to the surface of the paper. In particular, the improvement resides in the incorporation of an amine functional polyvinyl alcohol polymer as a binder for the ink jet coating.

Amine functional polyvinyl alcohols are known and representative examples of such amine functional polyvinyl alcohols are set forth in Robeson et al. U.S. Pat. No. 5,380,403 and are incorporated by reference. For purposes of completeness and expanding upon the general teachings of Robeson et al., methods for preparing amine functional poly(vinyl alcohols) include copolymerization of vinyl acetate with an N-vinylamide, e.g., N-vinylformamide or N-vinyl acetamide, or copolymerization with allyl amine followed by hydrolysis, or by polymerization of vinyl acetate, followed by hydrolysis to form the polyvinyl alcohol derivative and then by reaction with 4-amino butyraldehyde dimethyl acetal. Other routes may be used to generate the same or similar types of amine functional polyvinyl alcohols.

The synthesis of the precursor vinyl acetate copolymer can be conducted in solution, slurry, suspension or emulsion type polymerizations. Rodriguez, in "Principles of Polymer Systems", p. 98–101, 403, 405 (McGraw-Hill, NY, 1970) describes bulk and solution polymerization and the specifics of emulsion polymerization. When preparing poly(vinyl acetate) by suspension polymerization for example, the monomer is typically dispersed in water containing a suspending agent such as poly(vinyl alcohol) and then an initiator such as peroxide is added. The unreacted monomer is removed and the polymer filtered and dried. A preferred route involves polymerization of vinyl acetate and N-vinyl formamide in methanol which results in a "paste" like product which is amenable to hydrolysis.

A variety of comonomers, e.g., ethylenically unsaturated monomers, may be copolymerized with vinyl acetate and/or vinyl acetate and N-vinyl formamide or allyl amine to produce amine functional polyvinyl alcohols copolymers. Representative, but not totally inclusive, ethylenically unsaturated monomers include $C_1$–$C_8$ esters of acrylic acid and methacrylic acid, unsaturated carboxylic acids, and hydrocarbon monomers. Examples of esters include methyl methacrylate, ethyl acrylate, butyl acrylate, and 2-ethylhexyl acrylate. Others include hydroxy esters such as hydroxyethyl acrylate. The monomers typically are used at levels of about 10 mole percent and preferably less than about 5% by weight.

A preferred copolymer for use as a binder in ink jet coating formulations consists essentially of vinyl acetate and N-vinyl formamide copolymers containing from about 70 to 99 mole percent vinyl acetate and from about 1 to 30 mole percent N-vinyl formamide.

Reaction temperatures for forming copolymers of vinyl acetate and N-vinyl formamide and allyl amine are conventional. The reaction temperature can be controlled by the rate of catalyst addition and by the rate of the heat dissipation therefrom. Generally, it is advantageous to maintain a temperature from about 50° to 70° C. and to avoid temperatures in excess of about 80° C. While temperatures as low as 0° can be used, economically, the lower temperature limit is about 40° C.

The reaction time will also vary depending upon other variables such as the temperature, the catalyst, and the desired extent of the polymerization. It is generally desirable to continue the reaction until less than about 0.5% of the N-vinylformamide, allyl amine or vinyl acetate, if employed, remains unreacted. Under these circumstances, a reaction time of about 6 hours has been found to be generally sufficient for complete polymerization, but reaction times ranging from about 3 to 10 hours have been used, and other reaction times can be employed, if desired.

The hydrolysis of the vinyl acetate copolymers of this invention can be accomplished using methods typically utilized for poly(vinyl alcohol). Either acid or base hydrolysis or combinations thereof can be conducted to yield the amine functional poly(vinyl alcohols) of this invention. The hydrolysis often is conducted in several steps; the first step involving contacting with a catalytic amount of base (e.g. KOH, NaOH) which results in the hydrolysis of vinyl acetate groups. Hydrolysis of the vinyl amide groups can be accomplishment by higher levels of base or by acid addition followed by proper time/temperature to yield the desired level of hydrolysis. In the case of acid hydrolysis, the amine group is protonated to yield a positive charge neutralized with an anionic group (e.g. $Cl^-$, $Br^-$, $HSO_4^-$, $H_2PO_4^-$, and the like). Both the amine (—$NH_2$) or protonated versions ($NH_3^+X^-$) are suitable in this invention. Acids suitable for effecting hydrolysis include mineral acids such as hydrochloric, sulfuric, nitric, phosphoric and other mineral acids commonly used, as well as organic acids such as para-toluene sulfonic acid, methanesulfonic acid, oxalic acid and the like. Acidic salts comprised of weak bases and strong acids, e.g., ammonium bisulfate, alkyl ammonium bisulfates such as tetrabutylammonium bisulfate can be used. For further detail, the hydrolysis of poly(vinyl alcohol) and copolymers is described in the book "Poly(vinyl alcohol): Properties and Applications", ed. by C. A. Finch, John Wiley & Sons, New York, 1973, p. 91–120, and "Poly(vinyl alcohol) Fibers" ed. by I. Sokuruda, Marcel Dekker, Inc., New York, 1985, p. 57–68. A recent review of poly(vinyl alcohol) was given by F. L. Marten in the Encyclopedia of Polymer Science and Engineering, 2nd ed., Vol. 17, p. 167, John Wiley & Sons, New York, 1989. Both references are incorporated by reference.

Another potential route for achieving amine functional poly(vinyl alcohols) for use in preparing the ink jet coatings, as noted supra, involves the reaction of specific blocked alkyl amino aldehydes with polyvinyl alcohol or polyvinyl alcohol copolymers to produce amino functional polyvinyl alcohols. Blocked alkyl aldehydes include 4-amino butyral dimethyl acetal and other alkyl acetals ($C_{1-4}$) which react with polyvinyl to produce the 4-amino alkylal of polyvinyl alcohol, e.g., the 4-aminobutryral of polyvinyl alcohol.

The incorporation of primary amine functionality in the amine functional polyvinyl alcohol, e.g., hydrolyzed vinyl acetate/N-vinylformamide or hydrolyzed vinyl acetate/allyl amine copolymers or polyvinyl alcohol/aminobutyral polymers is within the range of from about 1 to amounts of up to about 30, preferably about 5 to 20 mole %. The desired level of vinyl acetate conversion to vinyl alcohol is from about 75 to 100%, preferably from about 80 to 99% hydrolysis and the level of vinylamide conversion to vinylamine is from about 25 to fully hydrolyzed, e.g., about 100%. In some preferred embodiments the hydrolyzed vinyl acetate is present in an amount of from about 80 to 95 mole percent.

The following sets forth operative and preferred ranges regarding the use of an amine functional polyvinyl alcohol. It is understood that the values identified are "about" or approximate ranges.

| | Operative and Preferred Ranges of the Composition: Primary Amine Functional PVOH | |
|---|---|---|
| | Operative Range | Preferred Range |
| Molecular weight (wt. average) | 10,000–170,000 | 8,000–110,000 |
| Primary Amine Content | 1–30 Mole % | 5–20 Mole % |
| Acetate Hydrolysis | 80%–99% | 98%–99% |
| wt. % binder in inkjet coating | 10–100% | 20–60% |
| Coating pH | 3–10 | 4–7 |

Ink jet coating formulations typically incorporate silica pigment and possibly a small amount of another mineral pigment in the formulation. Typically, the mineral pigment is silica and is incorporated in the ink jet coating formulation in amounts which range from about 1 to 90%, preferably about 30 to 85%, by weight. The level of binder (solids basis) will range within conventional levels or about 20 to 80% by weight of the ink jet formulation. The levels of pigment and binder depend significantly upon the type of coater used in the preparation of the ink jet paper. Synthetic aluminum silicates having surface areas of about 100 $m^2$ per gram as well as clay, talc, calcium carbonate, magnesium silicate and the like have been used as fillers in ink jet coating compositions and can be used. The preferred filler for ink jet coating compositions is silica having a surface area of about 50 to 700 $m^2$/gram. Ink jet formulations may also contain conventional additives such as defoamers, surface active agents, dyes, ultraviolet absorbents, pigment dispersants, mold inhibitors, thickeners and water-resisting agents.

The ink jet formulation usually is applied to the paper surface in amounts ranging from about 2 to 20 grams per $m^2$. Coat weight is somewhat dependent upon the type of coating applicator. The ink jet coating incorporating the amine functional polyvinyl alcohol is supplied to the paper surface itself rather than to paper stock prior to sheet formation.

Not intending to be bound by theory, it is believed the amine group in the amine functional polymers provides a cationic charge on the paper surface which reacts with the anionic sulfonic acid groups of the direct or acid dye of the ink jet inks to form an insoluble salt. By forming an insoluble salt, the inks become waterfast on the paper surface and the lightfastness is improved in those paper products incorporating the amine functional polyvinyl alcohol as compared to ink jet coatings incorporating poly(vinyl alcohol) homopolymer as the binder. Pigment binding strength, and silica pigment binding strength in particular, is improved with the use of the ink jet coatings incorporating the amine functional poly(vinyl alcohol) polymers in comparison to the ink jet coatings incorporating the poly(vinyl alcohol) homopolymer due to the strong absorption of the amines with the silanol group on the silica pigment.

The following examples are provided to illustrate the preparation of suitable amine functional polyvinyl alcohols and to illustrate ink jet coating systems for paper.

EXAMPLE 1

Procedure for Forming Primary Amine Functional Polyvinyl Alcohols

A poly(vinyl alcohol/vinyl amine) copolymer herein referred to as PVOH/$PVNH_2$ (6 mole % vinyl amine) was prepared by first polymerizing a vinyl acetate/N-vinylformamide (94/6 molar) copolymer in methanol by free radical polymerization procedures. The vinyl acetate/N-vinyl formamide copolymer was hydrolyzed to a vinyl alcohol/N-vinylformamide copolymer by alkali saponification of vinyl acetate using 0.1 molar sodium methoxide in methanol. The vinyl alcohol/N-vinylformamide copolymer was hydrolyzed to a vinyl alcohol/vinyl amine-HCl copolymer by heating at 90° C. for 6 hours in distilled water to which concentrated HCl was added. The product was precipitated using methanol and then dried in a vacuum oven. The average molecular weight of the PVOH/$PVNH_2$ copolymer was about 95,000 (Mw), the percent hydrolysis of the acetate was 100% and the percent hydrolysis of the N-vinylformamide was 100%.

A second poly(vinyl alcohol/vinyl amine) copolymer (PVOH/$PVNH_2$) (12 mole % vinyl amine) was prepared by first polymerizing a vinyl acetate/N-vinylformamide (88/12 molar) copolymer in methanol by free radical polymerization procedures. The molecular weight of the PVOH/$PVNH_2$ copolymer was 96,000, the percent hydrolysis of the acetate was 100% and the percent hydrolysis of the N-vinylformamide was 100%.

EXAMPLE 2

Procedure for Producing Primary Amine Functional Polyvinyl Alcohol Using 4-Amino Butyraldehyde Dimethylacetal (12 mole % amine)

Poly(vinyl alcohol) (Airvol 107) was dissolved in water (270 ml) at 70° C. under $N_2$. After dissolution, concentrated hydrochloric acid (16.34 g, 0.170 mole) and 4-aminobutyraldehyde dimethyl acetal (ABAA) (18.14 g, 0.136 mole) were added to the reaction along with additional water (20 ml). The reaction was continued at 75° C. for 6 hours and cooled to room temperature. The polymer product was isolated by precipitation in acetone, washed with further acetone and dried in a vacuum oven (60° C./1 torr). The composition of the resultant polymer as determined by $^{13}C$ NMR was 12% mole % 4-aminobutyral incorporation.

EXAMPLE 3

Coating Adhesive Strength

Several silica pigmented coatings were prepared in conventional manner for the purpose of evaluating coating adhesive strength, one type incorporating a polyvinyl alcohol homopolymer and the other type incorporating a PVOH/$PVNH_2$ copolymer as the binder. The coatings were formulated with 100 parts precipitated silica pigment and 40 parts of Airvol 125 polyvinyl alcohol (A 125) in the one case and an amine functional polyvinyl alcohol of the type in Example 1 having 12 mole % amine MMW PVOH/$PVNH_2$ in the other case and then applied to the paper at a coating weight of approximately 6 grams/$m^2$. In preparing the coatings the polyvinyl alcohol was solubilized in water to a concentration of about 10% solids by weight. The pigment was then added. The testing was performed on an IGT model AIC2-5 following TAPPI procedure T514. The larger the value, the greater the coating strength. Table 1 sets forth conditions and results.

TABLE 1

IGT Pick Strength of Coating Containing PVOH Homopolymer and PVOH/$PVNH_2$ Copolymer

| Sample Identification | IGT Pick Strength |
|---|---|
| 40 parts A125 (99.3% hydrolysis MMW PVOH[1]) | 6.87 |
| 40 parts 12 mole % MMW PVOH/$PVNH_2$[2] | 7.83 |

[1]MMW PVOH refers to medium molecular weight or weight average molecular weight of approximately 110,000;
[2]MMW PVOH/$NH_2$ refers to medium molecular weight or weight average molecular weight of approximately 96,000.

The results show the vinyl alcohol/vinylamine copolymer containing 12 molar % hydrolyzed N-vinylformamide gave higher pick strengths than the PVOH homopolymer, thus showing the enhanced binding properties of the ink jet coating due to the presence of the primary amine.

EXAMPLE 4

Printed Ink Optical Density

Sheets of uncoated base sheet were coated for the purpose of evaluating ink jet optical density. Several colors were evaluated. One set of base sheets was coated with an ink jet coating comprising PVOH and silica pigment and another set was coated with an ink jet coating comprising 6 mole % MMW PVOH/$PVNH_2$ and silica pigment coating using a Meyer Rod drawn down bar. The level of binder was varied from 70 weight parts to 30 weight parts per 100 weight parts silica. Coat weight was in the range of 4 to 6 grams/$m^2$. After coating and drying, the sheets were printed with an Hewlett Packard 560 ink jet printer using an HP test pattern distributed by Hewlett Packard for the purpose of testing ink jet paper media. After printing the samples were measured for optical density using a Tobias IQ 200 Reflection Densitometer. FIGS. 1 through 5 compare the ink optical density of the ink jet coatings comprising PVOH/$PVNH_2$ copolymer binder versus the ink jet coatings comprising the standard PVOH binder. In the Figures:

100% PVOH means that no silica was incorporated into the ink jet coating formulation.

Airvol 125 polyvinyl alcohol is 99.3% hydrolyzed and has a molecular weight (Mw) of 100,000.

Airvol 325 polyvinyl alcohol is 98.0% hydrolyzed and has a molecular weight (Mw) of 110,000.

Airvol 523 polyvinyl alcohol is 88.0% hydrolyzed and has a molecular weight (Mw) of 110,000.

PVOH/PVAm is another abbreviation for PVOH/$PVNH_2$, the amine functional polyvinyl alcohol of Example 1.

FIG. 1 shows that monochrome ink jet optical density for the paper having the ink jet coating incorporating the PVOH/$PVNH_2$ binder was superior to the paper having the ink jet coating incorporating the polyvinyl alcohol in all cases except at the highest loading. On the other hand, the PVOH/$PVNH_2$ based coating remained essentially constant at all levels.

Figure 2:
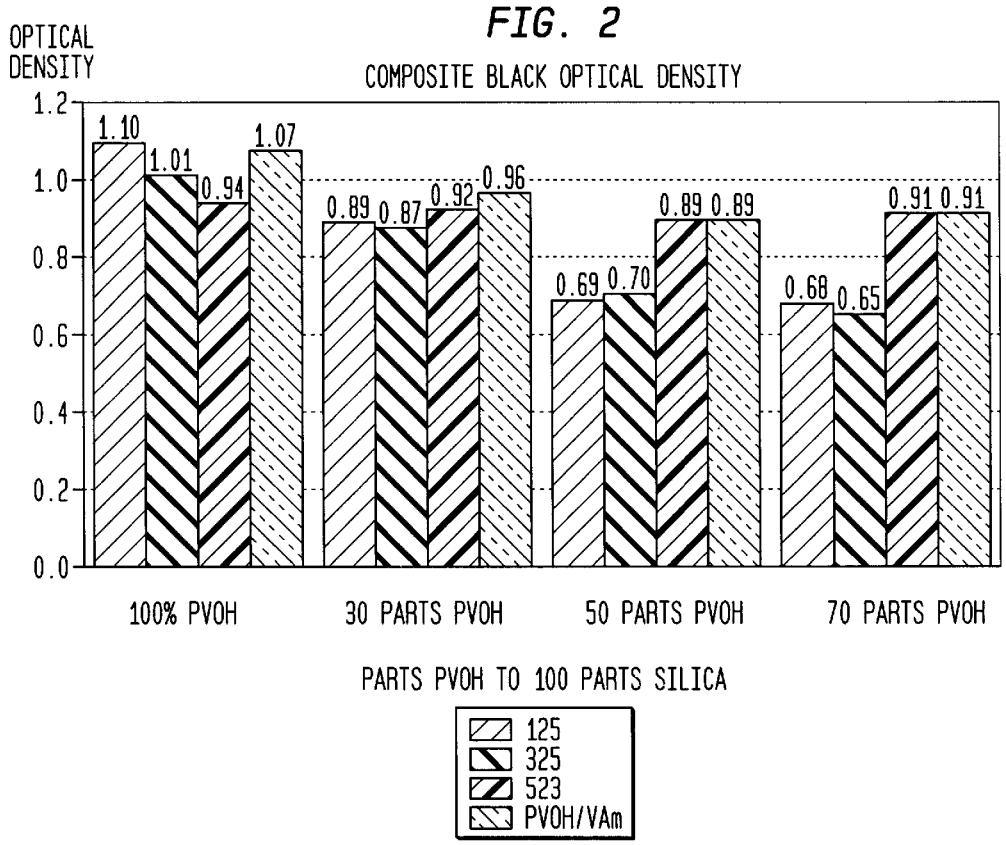
FIG. 2 is a bar graph showing composite black optical density as a function of the resin employed and amount of mineral filler.

FIG. 2 shows that at low levels of binder to silica, the PVOH/V am was superior to the PVOH thus showing enhanced binding strength.

Figure 3:
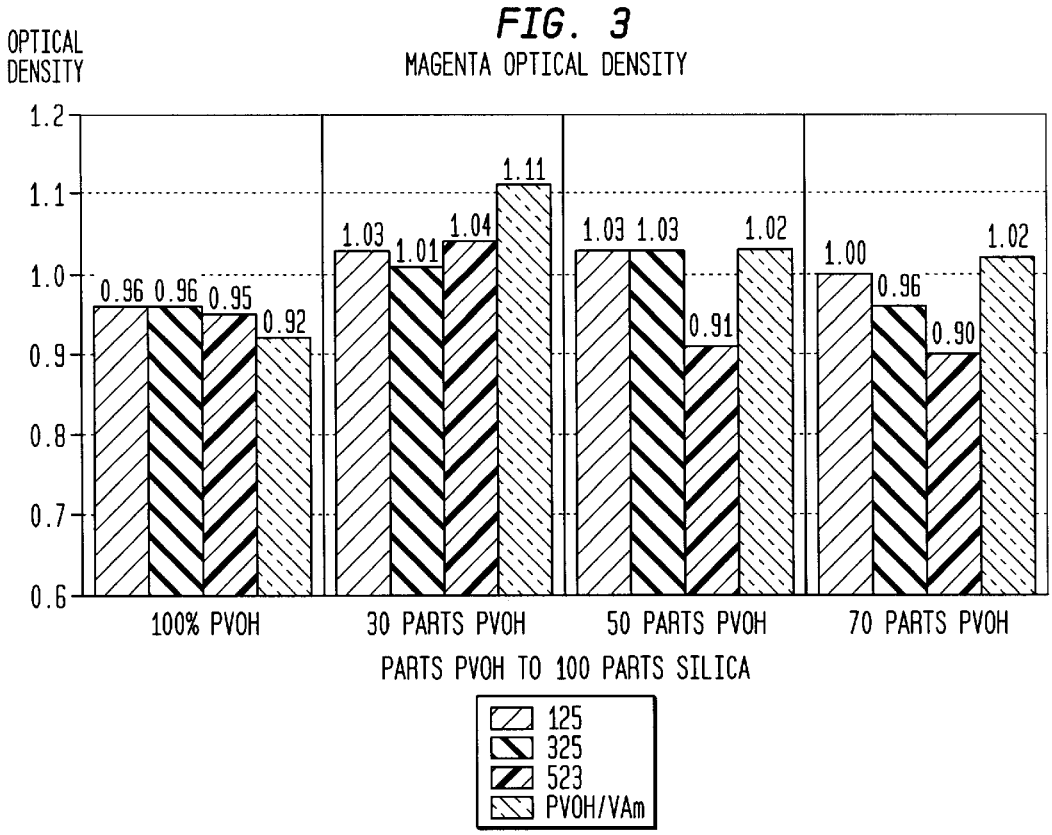
FIG. 3 is a bar graph showing magenta optical density as a function of filler level and resin employed.

FIG. 3 compares the magenta optical density achieved with the various coatings and particularly that the PVOH/V Am copolymer was superior in about every category to the PVOH and especially at the low binder to pigment levels.

Figure 4:
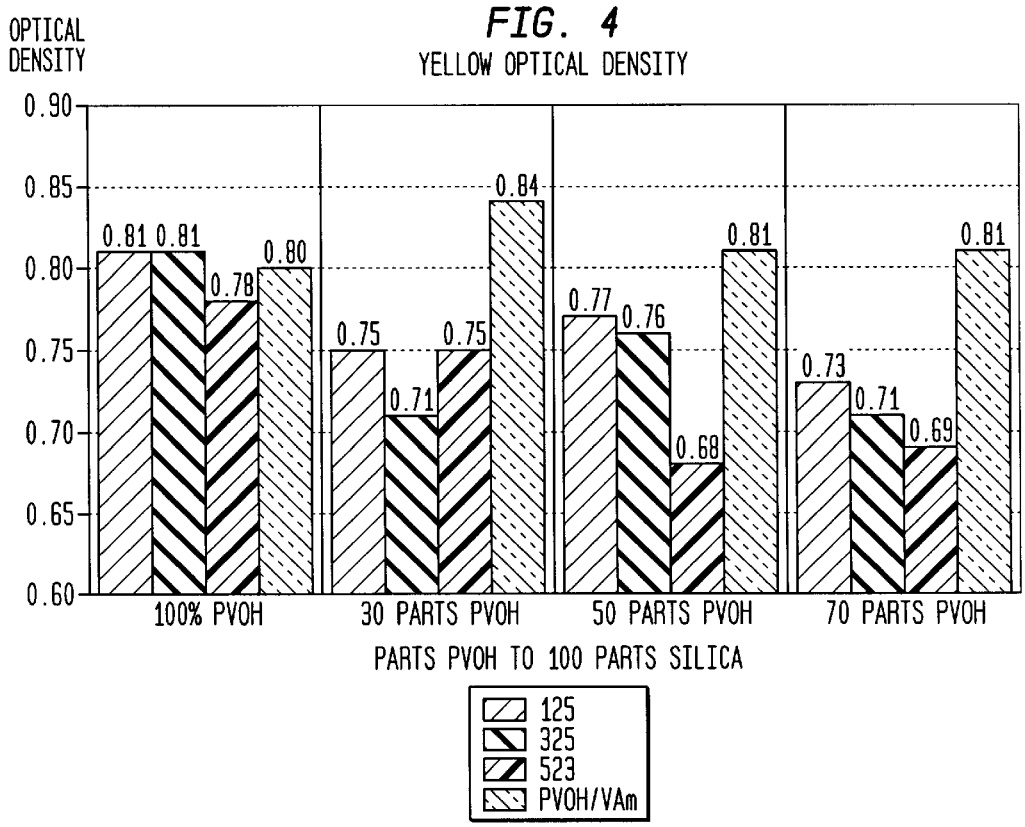
FIG. 4 is a bar graph showing yellow optical density as a function of the resin employed and silica content.

It may be seen in FIG. 4 that the polyvinyl alcohol/polyvinylamine binder was significantly better in performance vis-à-vis PVOH in the yellow optical density test. In contrast to the previous optical density test, substantially superior results were obtained with the amine functional polyvinyl alcohol at all levels.

Figure 5:
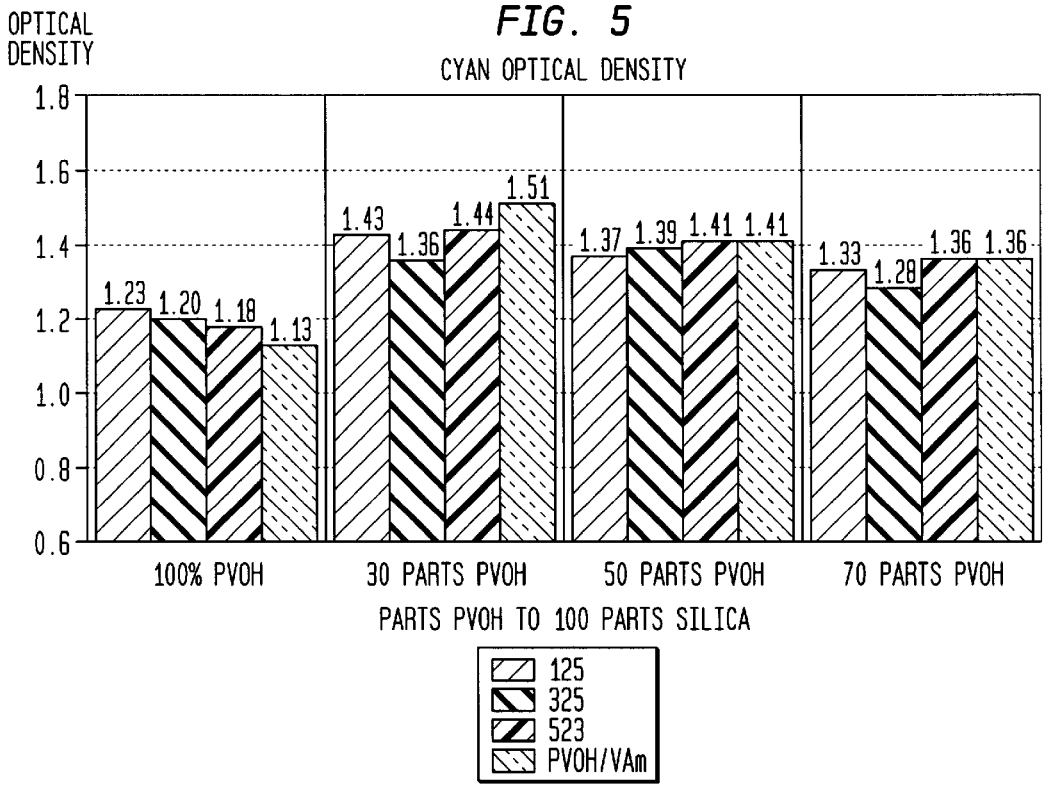
FIG. 5 is a bar graph showing cyan optical density as a function of the resin employed and the silica filler level.

It is seen in FIG. 5 that comparable results were obtained with the PVOH/V Am binder at high loadings but greater properties at the lower loading.

EXAMPLE 5

Waterfastness

The waterfastness of inks printed onto a paper coated with an ink jet coating incorporating PVOH/$PVNH_2$ as the binder was compared to paper coated with the ink jet coating incorporating the PVOH homopolymer. The test was performed by first measuring the monochrome black ink density after printing. The printed area was then immersed in distilled water for 30 seconds and dried on a hot plate under tension. The optical density was then measured again. The results are set forth in Table 2.

TABLE 2

Waterfastness on Ink Jet Paper Coated With PVOH and PVOH/$PVNH_2$ Binders Δ Represents the Difference in Optical Density Between Pre Wet and Post Wet Paper Products

| PVOH Type Parts PVOH per/100 parts silica Pigment | Monochrome Black Optical Density Pre wetting | Monochrome Black Optical Density Post Wetting | Δ Optical Density |
|---|---|---|---|
| 99.3% Hydrolysis Medium MW 30 Parts | 1.33 | 0.83 | −0.50 |
| 98.0% Hydrolysis Medium MW 30 Parts | 1.36 | 1.07 | −0.29 |
| 88.0% Hydrolysis Medium MW 30 Parts | 1.36 | 0.96 | −0.40 |
| 6 Mole % PVOH/$PVNH_2$ Medium MW 30 Parts | 1.44 | 1.35 | −0.09 |
| 6 Mole % PVOH/$PVNH_2$ Medium MW 50 Parts | 1.41 | 1.36 | −0.05 |
| 6 Mole % PVOH/$PVNH_2$ Medium MW 70 Parts | 1.30 | 1.30 | −0.0 |
| 12 Mole % PVOH/$PVNH_2$ Medium MW 40 Parts | 1.42 | 1.42 | −0.0 |

Table 2 shows that the waterfastness of printed inks is improved when the printing is effected onto a paper product having a silica based ink jet coating which incorporates the amine functional polyvinyl alcohol. As a binder, these results show that the loss in optical density after wetting decreases as the level of 6 mole % PVOH/$PVNH_2$ was increased in the coating. These results also show that the ink jet coating incorporating the 12 mole % PVOH/$PVNH_2$ provides improved waterfastness as compared to the 6 mole % PVOH/$PVNH_2$ copolymer at approximately equal addition levels.

EXAMPLE 6

Rheology of Ink Jet Coatings

Several ink jet coating formulations were prepared using different binders to determine their effect on the rheology of the resulting ink jet formulations. The graph (FIG. 6) demonstrates the shear vs. viscosity response for a 13% solids coating formulated with 100 parts silica and 40 parts binder. Four binder types were used and they are:

1. Fully hydrolyzed medium molecular weight PVOH (FH MMW); the molecular weight was approximately 110,000.
2. Partially hydrolyzed medium molecular weight PVOH ($PHNH_2$ MMW) ); the molecular weight was approximately 110,000.
3. PVOH/$PVNH_2$ medium molecular weight 6 mole % HCl salt); the molecular weight was approximately 95,000.
4. PVOH/$PVNH_2$ medium molecular weight 12 mole % free base; the molecular weight was approximately 96,000.

The shear viscosity of the coatings was measured with an ACAV High Shear Capillary Viscometer at temperatures of 35–40° C.

Figure 6:
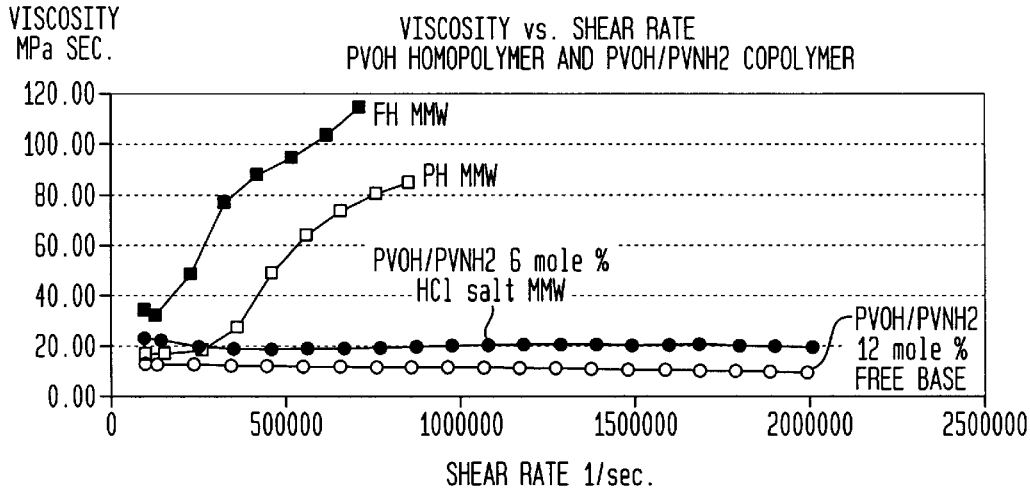
FIG. 6 is a plot of viscosity vs. shear rate for various ink jet coating formulations.

The results in FIG. 6 show that the silica based ink jet coatings incorporating the poly(vinyl alcohol)/vinyl amine copolymer binders produce a much lower viscosity response as compared to ink jet coatings incorporating poly(vinyl alcohol) homopolymer as the binder. The mechanism for the reduced viscosity response to high shear is not known but may relate to the high absorption of the amine functional PVOH onto the surface of the silica pigment. It is believed a greater absorption of the copolymer onto the surface of the silica would prevent the polymer chains from extending into the liquid phase of the coating thereby lowering the overall viscosity of the coating. The data also supports the view that the greater the amine content in the binder, the greater the absorption and the lower the shear thickening response.

EXAMPLE 7

Lightfastness

Several ink jet formulations were prepared for the purpose of determining the lightfastness of the formulations. The following table demonstrates the UV lightfastness of ink jet printed sheets with coatings based on 100 parts precipitated silica pigment. Lightfastness was determined by measuring the optical density of ink jet printed papers before and after exposure 54 hour UV light exposure. The optical densities of the paper were measured with a Tobias IQ 200 Reflection Densitometer. The printed sheet then was exposed to UV light using a Q-U-V Accelerated Weathering Tester. The values were recorded and set forth in Table 3, Δ represents the difference in optical density between the initial and exposed samples, the lower the value, the better the lightfastness.

TABLE 3

Lightfastness of PVOH Homopolymer Versus PVOH/PVNH2 Copolymer
Optical Density Difference Between Initial and 54 hour UV Exposure
Δ Represents the Difference in Optical Density After 54 Hour Exposure

| Parts Binder 100 Parts Silica | Monochrome Black | Magenta | Yellow | Cyan | Composite Black |
|---|---|---|---|---|---|
| 30 parts PVOH 98.0% Hydrolysis Medium MW | Δ = 0.26 | Δ = 0.65 | Δ = 0.16 | Δ = 1.00 | Δ = 0.33 |
| 30 parts $PVOH/PVNH_2$ 6 mole % MMW | Δ = 0.11 | Δ = 0.52 | Δ = 0.12 | Δ = 1.08 | Δ = 0.25 |
| 50 parts $PVOH/PVNH_2$ 6 mole % MMW | Δ = 0.11 | Δ = 0.41 | Δ = 0.10 | Δ = 0.92 | Δ = 0.20 |
| 70 parts $PVOH/PVNH_2$ 6 mole % MMW | Δ = 0.14 | Δ = 0.29 | Δ = 0.08 | Δ = 0.82 | Δ = 0.21 |
| 40 parts $PVOH/PVNH_2$ 12 mole % MMW | Δ = 0.15 | Δ = 0.25 | Δ = 0.08 | Δ = 0.79 | Δ = 0.18 |

The results show that the lightfastness of ink jet printed colors improved when the $PVOH/PVNH_2$ copolymer was used as a binder for the ink jet coating compared to when PVOH homopolymer was used as the binder for ink jet coatings. Lightfastness also improved with increased $PVOH/PVNH_2$ binder level in the coating as well as with increased amine content in the copolymer backbone. The mechanism for improved lightfastness is not understood but may be due an increased light stability of the salt complex formed between the sulfonic acid groups of the dyes used in the inks and the amine in the amine functional polyvinyl alcohol.

EXAMPLE 8

Dry Time

Ink jet coating formulations were prepared which vary in the % hydrolysis of the various PVOH binders and compared for ink dry time (the time it takes the ink to dry after printing from an ink jet printer) to a similar formulation which contained a 12 mole % medium molecular weight PVOH/PVAm binder. The coating consisted of a 100 parts precipitated silica pigment with 40 parts of the PVOH or PVOH/PV Am binder prepared at a total solids level of 15%. The formulations were Meyer Rod coated on to an base paper at coat weights between 7 and 8 grams/square meter.

Figure 7:
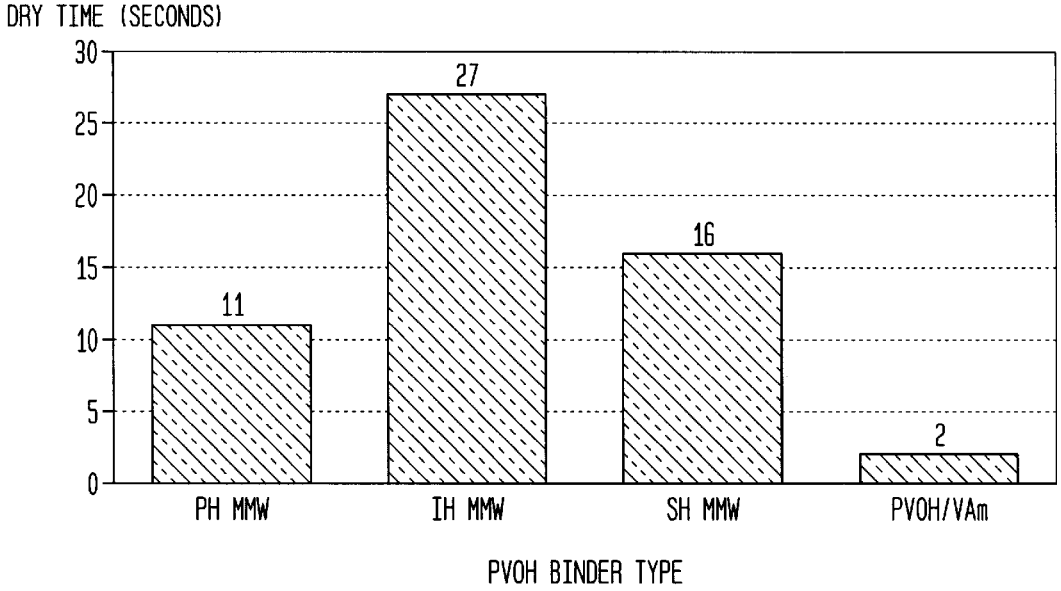
FIG. 7 is a bar graph illustrating ink dry time on various silica/poly(vinyl alcohol) coatings.

The coated papers were tested for ink dry time according to procedures outlined in the "Hewlett Packard Paper Acceptance Criteria For HP Deskjet 500C, 550C & 560C Printers". Results are shown in FIG. 7, wherein:

PH MMW refers to 87% hydrolysis at approximately 110,000 average molecular weight;

IH MMW refers to 96% hydrolysis at approximately 110,000 average molecular weight;

SH MMW refers to 87% hydrolysis at approximately 110,000 average molecular weight; and PVOH/PVAm refers to 12 mole % vinyl amine at 95,000 average molecular weight.

FIG. 7 demonstrates the improved dry time of the ink jet formulations containing PVOH/PV Am versus the formulations containing the PVOH homopolymer.

EXAMPLE 9

Ink Jet Impregnated Paper Product

Paper products were prepared in accordance with the general procedure of U.S. Pat. No. 4,880,497 in that the paper product was impregnated with the binder prior to coating rather than being applied the surface of the paper as a coating. The objective was to determine whether comparable ink jet properties could be achieved by impregnation, vis-à-vis coating, in addition to improving the paper's wet and dry strength.

As a second objective, the amine functional polyvinyl alcohol, viz., hydrolyzed vinyl acetate/n-vinylformamide was replaced and a commercial quaternized polyvinyl alcohol substituted therefor.

Figure 9:
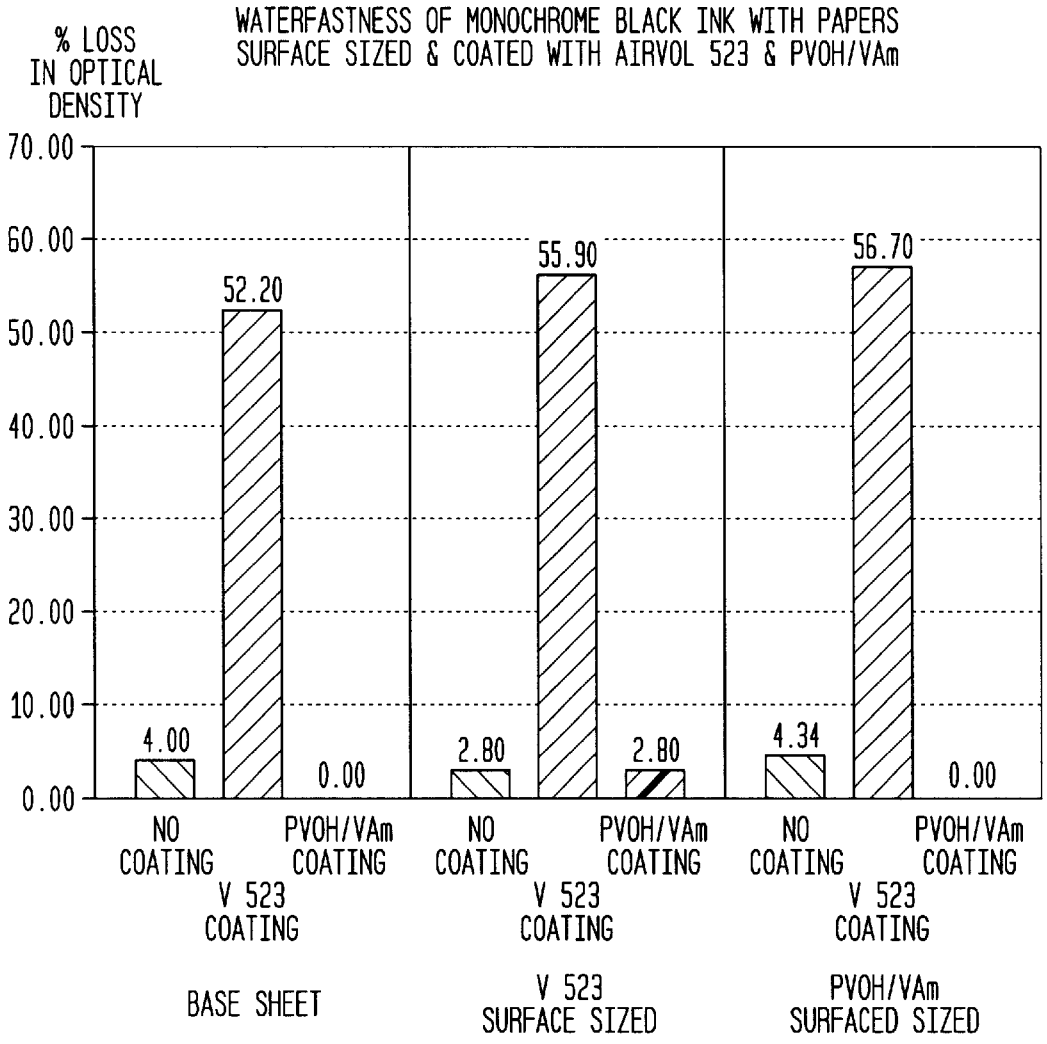
FIG. 9 is a bar graph illustrating waterfastness of monochrome black ink with papers surface sized and coated with various resins.
Figure 10:
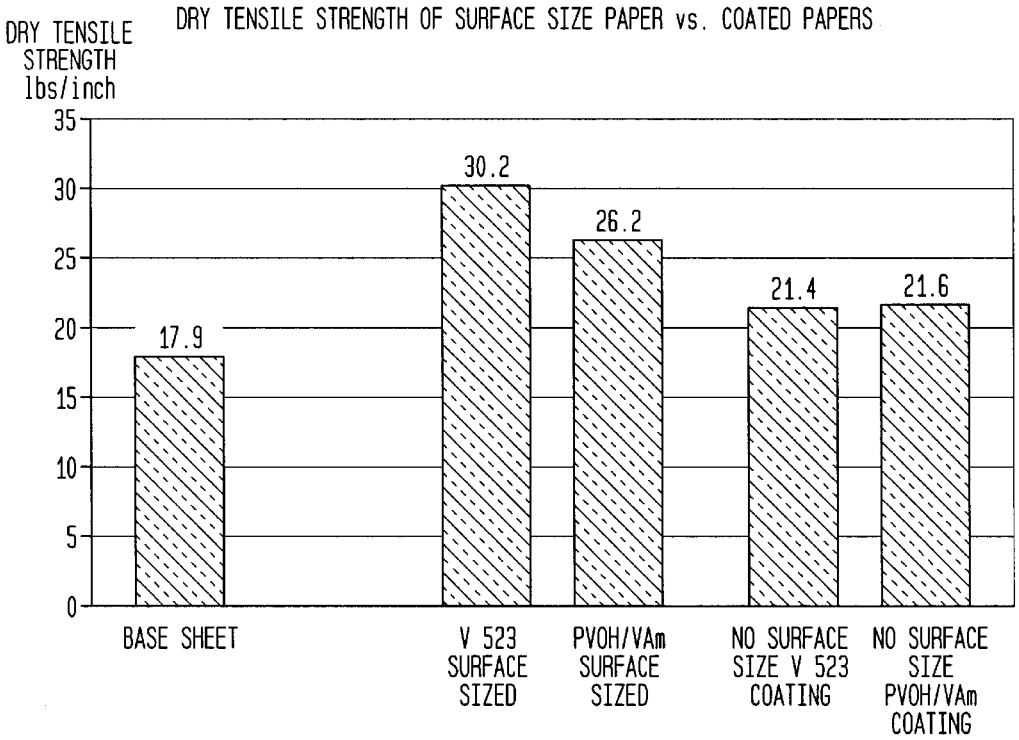
FIG. 10 is a bar graph showing dry tensile strength of surface sized versus coated papers.

Paper products were prepared by adding the aqueous binder to a paper substrate at the size press as opposed to applying the binder to the surface of the paper as a paper coating. Three methods were employed as follows:

1. Three base sheets were prepared, one having no coating, another coated with polyvinyl alcohol and another coated with amine functional polyvinyl alcohol. Silica was bound to the paper via the binder; no silica was employed in the absence of the binder.
2. Three base sheets were prepared in accordance with 1 above except the paper was surface sized (impregnated) with polyvinyl alcohol prior to coating with polyvinyl alcohol or amine functional polyvinyl alcohol.
3. Three base sheets were prepared in accordance with 2 above except the paper was surface sized with the amine functional polyvinyl alcohol prior to coating with the respective binders. The results are set forth in FIGS. 8, 9 and 10.

Results Summary

Figure 8:
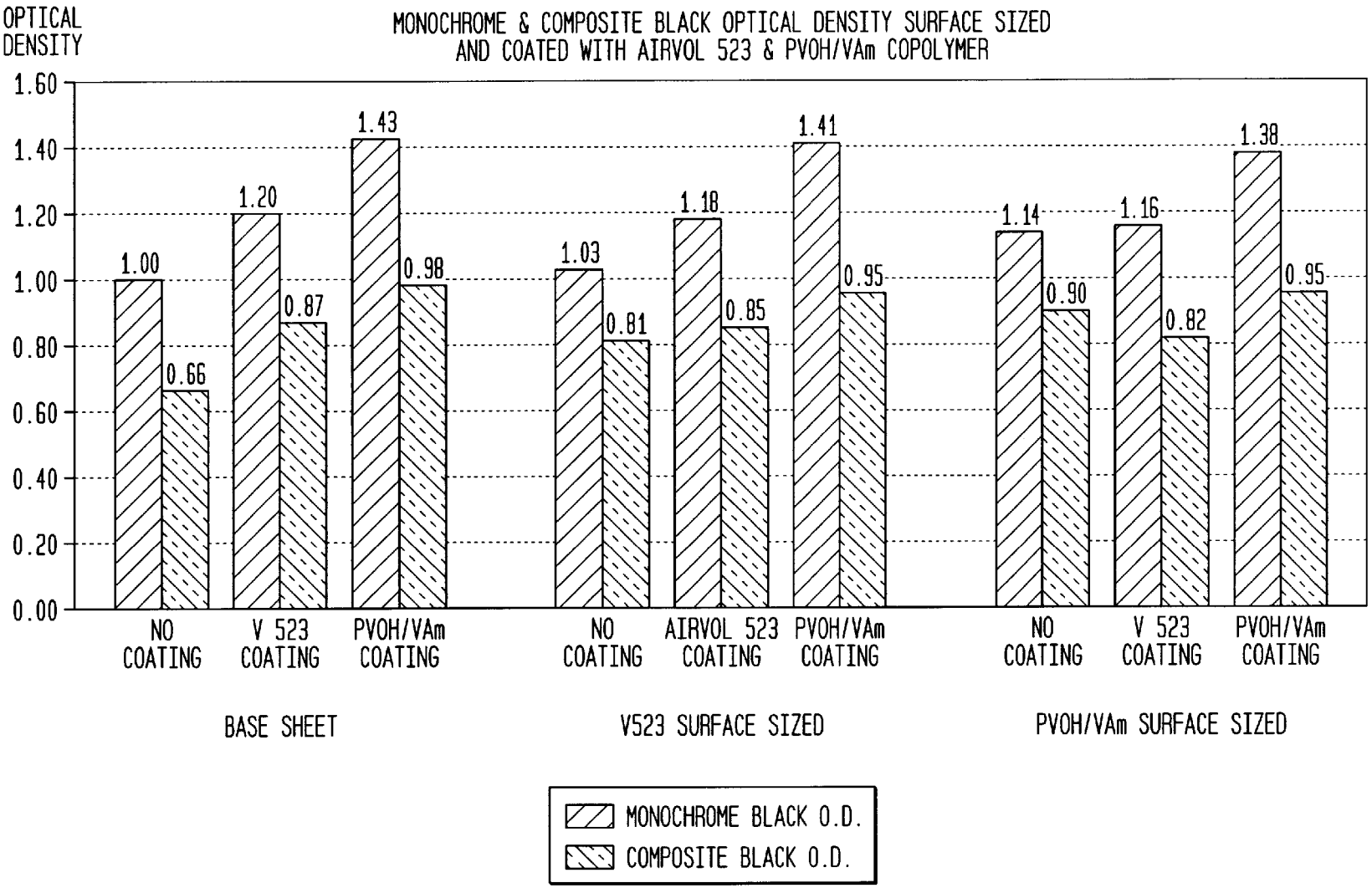
FIG. 8 is a bar graph showing monochrome and composite black optical densities for various coated and uncoated base sheets.

Surface sizing a paper substrate with 12 mole % medium molecular weight PVOH/V Am provided improved levels of optical density (one measure of ink jet printability) in comparison to sheets surfaced sized with Airvol 523 homopolymer and the non surface sized base sheet (FIG. 8). However, the results show that by applying the binder as a coating as opposed to impregnation, the ink jet printing quality is enhanced substantially. There appears to be little difference between the optical density in a $PVOH/PVNH_2$ coated paper and a $PVOH/PVNH_2$ impregnated and coated paper. Ink waterfastness of the three papers was very similar (see FIG. 9). Airvol 523 polyvinyl alcohol surface sized sheets provided a higher level of paper dry strength in comparison to the PVOH/V Am. Both surface size sheets provided strength greater than the base sheet.

EXAMPLE 10

This example provides a comparison between ink jet papers coated with a PVOH/$PVNH_2$ aqueous binder and one coated with a cationic polyvinyl alcohol sold by Kuraray as cationic polymer, C506. The results are shown in FIGS. 11 and 12.

Figure 11:
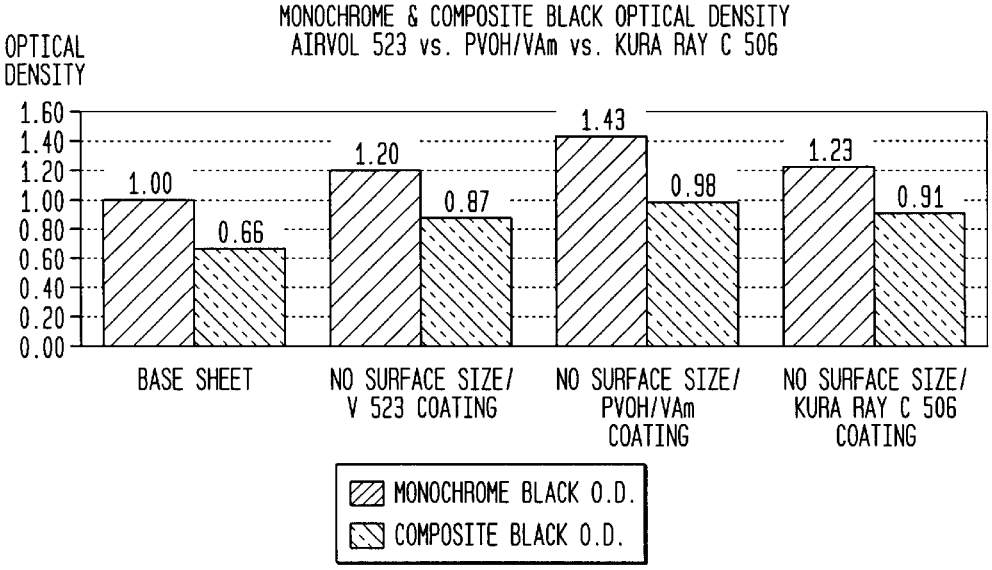
FIG. 11 is a bar graph of monochrome and composite black optical density for various coated papers.
Figure 12:
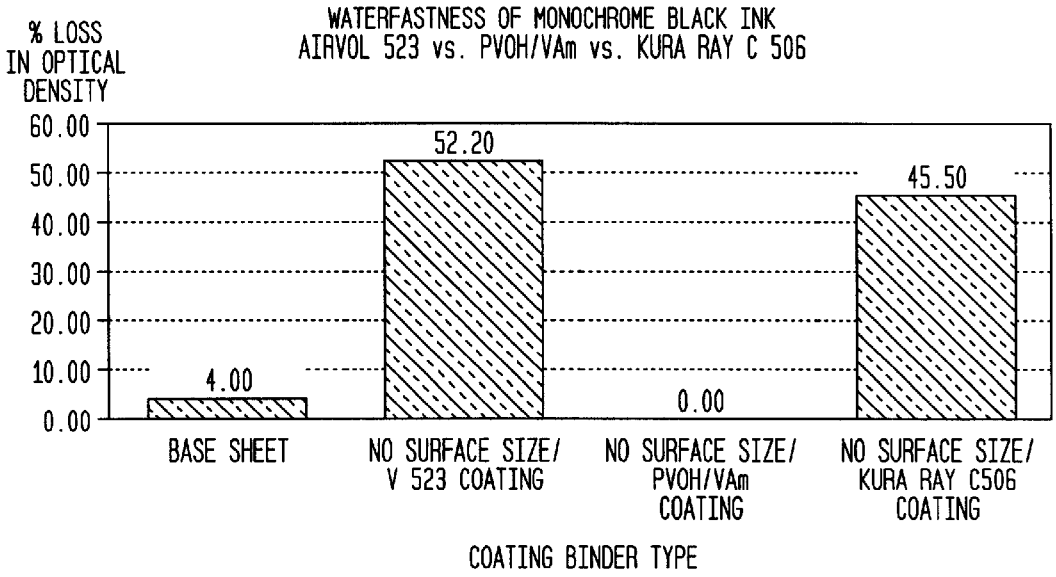
FIG. 12 is a bar graph showing waterfastness of monochrome black ink for coated and uncoated base sheets.

FIG. 11 shows that coating the base sheet with a coating containing 100 parts of silica pigment and 40 parts of PVOH/V Am provided levels of ink optical density which were much greater than coatings containing 100 parts of silica pigment with either 40 parts of Airvol 523 or 40 parts of the Kuraray cationic polymer, C506. All coated papers provided levels of optical density which were greater than sheets which were surface sized only. FIG. 12 shows that ink waterfastness was excellent with the PVOH/V Am coating and very poor with the Airvol 523 polyvinyl alcohol and the Kuraray cationic polyvinyl alcohol. Dry strength of all coated sheets were approximately equal to each other and slightly greater than the base sheet. The coated sheets were much lower in dry strength as compared to the surface sized sheets.

EXAMPLE 11

Ink Jet Paper Using 4-Amino Butyral Derivative of Polyvinyl Alcohol

Figure 13:
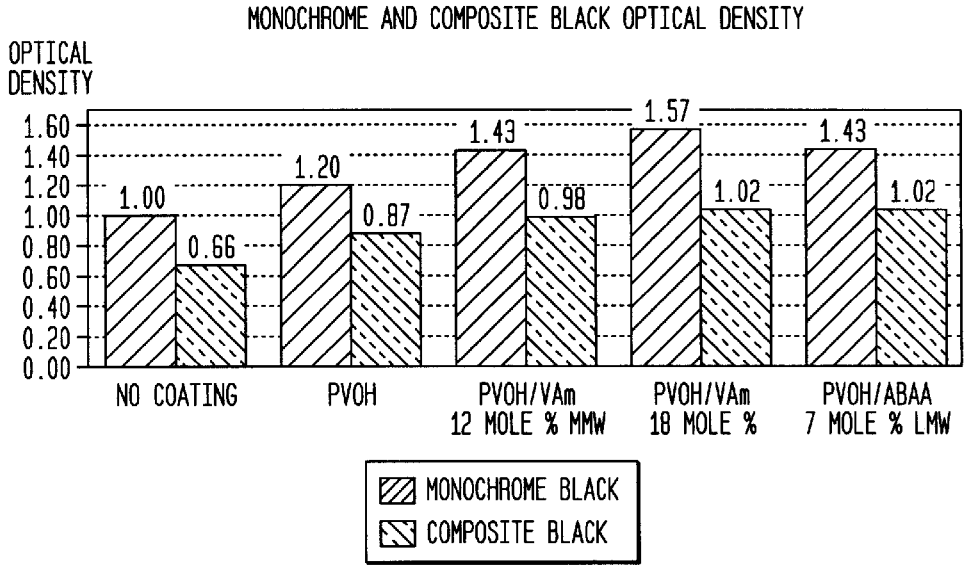
FIG. 13 is a bar graph showing monochrome black and composite black optical density for various coated and uncoated papers.

The procedure of Example 2 to make a 4-aminobutyral derivative of polyvinyl alcohol was followed except the polymer contained 7 mole % amine functionality. It was compared to polyvinyl alcohol as a binder and to other amine functional alcohols derived by the hydrolysis of a vinyl acetate-N-vinyl formamide copolymer having the mole % amine functionality set forth. FIG. 13 sets forth the results.

The results show each of the amine functional polyvinyl alcohols were superior to polyvinyl alcohol. The figure also shows that the 7% amine functionality was equivalent to the 12 and 18% mole functional hydrolyzed vinyl acetate/N-vinyl formamide polymer systems.

In summary, the amine functional polyvinyl alcohols provide excellent properties to ink jet coatings for paper products and particularly those ink jet coatings based upon silica. In almost every case the properties were improved vis-a-vis polyvinyl alcohol. When comparing the polyvinyl alcohol/polyvinyl amine binders, the 12 mole % amine was superior to 6 mole % amine. This is believed evidence that the amine provides cationic sites on the polymer backbone which react with the inks from the ink jet printer to improve the ink optical density, ink waterfastness, and ink light stability. The greater the amine content, the greater the improvements. The amine group also contributes to the binding power of the binder and silica. It is also observed that the 4-aminobutyral derivative of polyvinyl alcohol affords slightly superior results to the hydrolyzed vinyl acetate/N-vinylformamide polymers. This is believed due to the fact that the primary amine groups are in the form of extended side chains pendent from the polymer backbone wherein the hydrolyzed N-vinyl formamide groups are closely bound to the polymer backbone. It is believed the side chains allow the amine cationic site better access to the inks and also allows the amine to more easily combine with the silica.

What is claimed is:

1. In an ink jet paper product having applied to its surface an ink jet coating formulation comprising a mineral pigment and an aqueous based polymeric binder applied to its surface, the improvement which comprises incorporating a primary amine functional polyvinyl alcohol as the polymeric binder, wherein the primary amine functional polyvinyl alcohol is selected from the group consisting of a hydrolyzed copolymer of vinyl acetate and N-vinyl amide, a hydrolyzed copolymer of vinyl acetate and allyl amine and an aminoalkylal derivative of polyvinyl alcohol.

2. The paper product of claim 1 wherein the mineral pigment is silica.

3. The paper product of claim 2 wherein the primary amine functionality in said amine functional polyvinyl alcohol is from about 1 to 30 mole percent.

4. The paper product according to claim 3, wherein the primary amine functional polyvinyl alcohol is an aminoalkylal derivative of polyvinyl alcohol.

5. The paper product according to claim 4, wherein the primary amine functional polyvinyl alcohol is the 4-aminobutyral of polyvinyl alcohol.

6. The paper product according to claim 3, wherein the primary amine functional polyvinyl alcohol is a hydrolyzed copolymer of vinyl acetate and allyl amine.

7. The paper product according to claim 3, wherein the primary amine functional polyvinyl alcohol is a hydrolyzed copolymer of vinyl acetate and N-vinylamide.

8. The paper product according to claim 7 wherein said N-vinylamide is N-vinylformamide.

9. The paper product according to claim 7, wherein said N-vinylamide is N-vinylacetamide.

10. The paper product of claim 3 wherein the silica is present in an amount of from about 30 to 85% by weight of the ink jet coating formulation.

11. The paper product of claim 10 wherein the ink jet coating formulation is applied to the surface in an amount of from about 2 to 20 grams per $m^2$.

12. The paper product of claim 11 wherein the binder is incorporated into the ink jet coating formulation in an amount of from about 20 to 60% by weight.

13. The paper product of claim 11 wherein the copolymer polyvinyl alcohol and polyvinyl amine polymer is a hydrolyzed copolymer of vinyl acetate and N-vinylamide.

14. The paper product of claim 12 wherein the hydrolyzed copolymer consists essentially of hydrolyzed vinyl acetate and N-vinyl formamide and the hydrolyzed vinyl acetate is present in an amount from about 80 to 95 mole percent.

15. The paper product of claim 11 wherein the amine functional polyvinyl alcohol is the 4-aminobutyral of polyvinyl alcohol.

16. The paper product of claim 11 wherein the amine functional polyvinyl alcohol is a hydrolyzed copolymer of vinyl acetate and allyl amine.

17. In a process for preparing an ink jet recording sheet which comprises applying an ink jet coating to a paper substrate, said ink jet coating comprising a polymeric binder and a mineral pigment, the improvement which comprises utilizing a primary amine functional polyvinyl alcohol as the polymeric binder, wherein the primary amine functional polyvinyl alcohol is selected from the group consisting of a hydrolyzed copolymer of vinyl acetate and N-vinyl amide, a hydrolyzed copolymer of vinyl acetate and allyl amine and an aminoalkylal derivative of polyvinyl alcohol.

18. The process of claim 17 wherein the mineral pigment is silica.

19. The process of claim 18 wherein the primary amine functionality in said amine functional polyvinyl alcohol is from about 1 to 30 mole percent.

20. The process of claim 19 wherein the silica is present in an amount of from about 30 to 85% by weight of the ink jet coating formulation.

21. The process of claim 20 wherein the ink jet coating formulation is applied to the surface in an amount of from about 2 to 20 grams per $m^2$.

22. The process of claim 21 wherein the binder is incorporated into the ink jet coating formulation in an amount of from about 20 to 60% by weight.

23. The process of claim 22 wherein the copolymer polyvinyl alcohol and polyvinyl amine polymer is a hydrolyzed copolymer of vinyl acetate and N-vinylamide.

24. The process of claim 23 wherein the hydrolyzed copolymer consists essentially of hydrolyzed vinyl acetate and N-vinyl formamide and the hydrolyzed vinyl acetate is present in an amount from about 80 to 95 mole percent.

* * * * *